United States Patent [19]

Lee

[11] 4,225,125

[45] Sep. 30, 1980

[54] OPERATION TABLE

[75] Inventor: Norman J. Lee, London, England

[73] Assignee: Matburn (Holdings) Limited, London, England

[21] Appl. No.: 899,106

[22] Filed: Apr. 24, 1978

[30] Foreign Application Priority Data

Apr. 28, 1977 [GB] United Kingdom ..... 17768/77
Apr. 29, 1977 [GB] United Kingdom ..... 17973/77

[51] Int. Cl.[3] ..... A61G 13/00
[52] U.S. Cl. ..... 269/322
[58] Field of Search ..... 269/322–328; 180/43.17, 43.23, 43.2, 43.22

[56] References Cited

U.S. PATENT DOCUMENTS

| | | | |
|---|---|---|---|
| 2,794,694 | 6/1957 | Fullwood et al. | 269/325 |
| 2,855,209 | 10/1958 | Hull | 280/43.2 |
| 3,851,870 | 12/1974 | Cook | 269/322 |

*Primary Examiner*—Robert C. Watson
*Attorney, Agent, or Firm*—MaAulay, Fields, Fisher, Goldstein & Nissen

[57] ABSTRACT

A surgical operation table has a patient supporting surface supported on a column on a movable base. The base has a plurality of feet which can rest on the ground to support the base in a fixed position. The base can be moved on running wheels which are movable with respect to the base to and from a position in which they are engaged with the ground, and the feet are clear of the ground. A support frame is displaceable with respect to the base to move the running wheels into the position in which they are engaged with the ground and the feet are clear of the ground. The frame is also displaceable with respect to the base to enable the running wheels to move clear of the ground and the feet to engage the ground.

5 Claims, 5 Drawing Figures

OPERATION TABLE

BACKGROUND OF THE INVENTION

Surgical operation tables comprise a patient supporting surface sometimes called a table top, but hereinafter called a platform, a base, which may be fixed but which is usually movable, and a support column which supports the platform on the base in such a way that the platform can be raised or lowered with respect to the base. It is commonplace for such a table to have a platform composed of four sections arranged in end to end relationship. The two main or intermediate sections are usually called "trunk" sections and two outer or end sections, sometimes called extension sections, are fitted, often removably, to the trunk sections. The two trunk sections are capable of either being arranged in a common horizontal plane, thereby to provide a flat surface or of being arranged at an angle with respect to each other, i.e. of being arranged in the so-called reflex or flex positions, alternatively called "break" positions. The two trunk sections can be swung as a unit about an axis extending longitudinally of the platform, i.e. lateral tilt movement, or about an axis extending transversely of the platform, i.e. Trendelenburg or reverse Trendelenburg movement.

An object of the invention is to provide an improved surgical operation table of this kind.

SUMMARY

A surgical operation table or the like according to this invention comprises a patient supporting surface, a movable base and a column by which the patient supporting surface is mounted on the base wherein the said base comprises a plurality of feet which can rest on the ground to support the base in a fixed position and running wheels on which the base can be moved, the said wheels being movable with respect to the base to and from a position in which they are engaged with the ground and the feet are clear of the ground and a support frame displaceable with respect to the base to move the running wheels into the position in which they are engaged with the ground and the feet are clear of the ground, the said frame being also displaceable with respect to the base to enable the running wheels to move clear of the ground and the feet to engage the ground The support column is conveniently arranged towards one end of one of the trunk sections to facilitate an image intensification apparatus being positioned beneath the platform if desired, the various sections of the platform then being of X-ray translucent material.

The various movements of the trunk and extension sections may be effected under the control of control levers or buttons on a control arm which is mounted beneath the platform and is capable of being swung about a vertical axis so as to be accessible from each side of the table. The control arm may be extendable. The control levers or buttons may be operated to engage selected gears in a gear box, the various movements being effected by rotation of a handle or by electrical hydraulic or pneumatic means after the selected gears have been engaged.

The base preferably has a plurality of castors or the like mounted on the support frame and the frame is displaceable with respect to the base from a position in which the running wheels are engaged with the ground and the feet are clear of the ground through a position in which the castors or the like are engaged with the ground and both the feet and the running wheels are clear of the ground to a position in which the feet are engaged with the ground and the castors or the like and running wheels are clear of the ground.

DESCRIPTION OF AN EMBODIMENT

Figure 1:
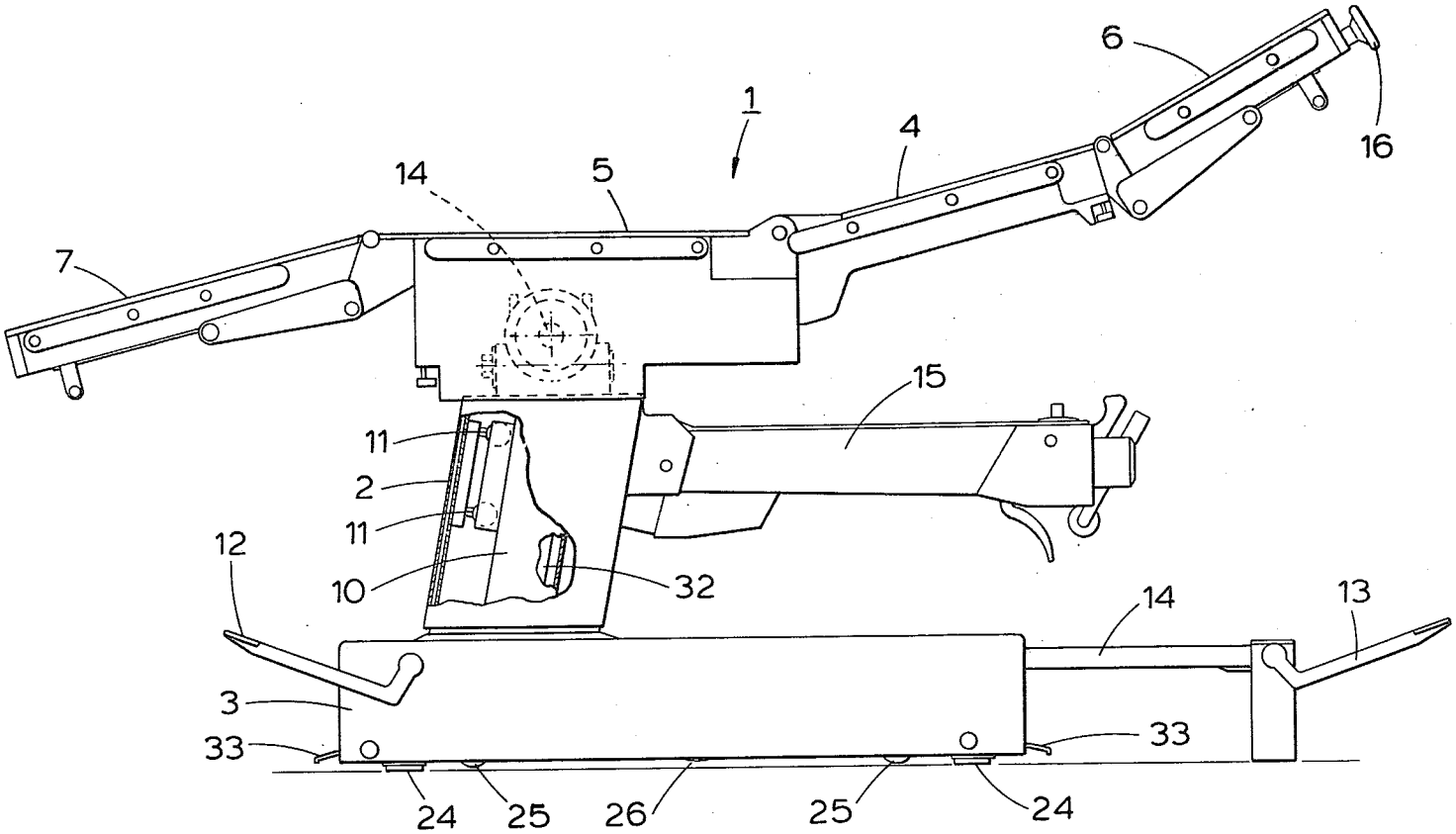
FIG. 1 is an elevation of a surgical operation table according to the invention.

A surgical operation table has a patient supporting platform or "table top" 1 carried by a support column 2 mounted on a movable base 3. The platform 1 is composed of two intermediate or trunk sections 4, 5 and two outer end or extension sections 6, 7 arranged in end to end relationship so that the platform 1 has a length sufficient to support a patient in a supine position. The two trunk sections 4, 5 are pivotally mounted on the support column 2 in such a way that they can be swung about an axis transverse to the platform so that they can be arranged either to provide a flat surface or to occupy the reflex or flex positions. The two trunk sections 4, 5 can also be swung about an axis extending longitudinally of the platform so as to provide Trendelenburg or reverse Trendelenburg movement. The mounting of the platform 1 on the support column 2 is also arranged to permit lateral tilt movement. The end sections 6, 7 are, of course, movable with the trunk sections and they are also movable independently of the trunk sections.

All the separate sections 4, 5, 6 and 7 of the platform 1 are of X-ray translucent material. The end section 6 is a head and the extension section 7 is a leg extension. The two sections 6, 7 may be of the same length or the leg extension section 7 may be and preferably is, longer than the head extension 6. These two end or extension sections 6, 7 are removably fitted to the trunk sections 4, 5 and are interchangeable with each other so that they can be arranged at either end of the table as is convenient.

Figure 2:
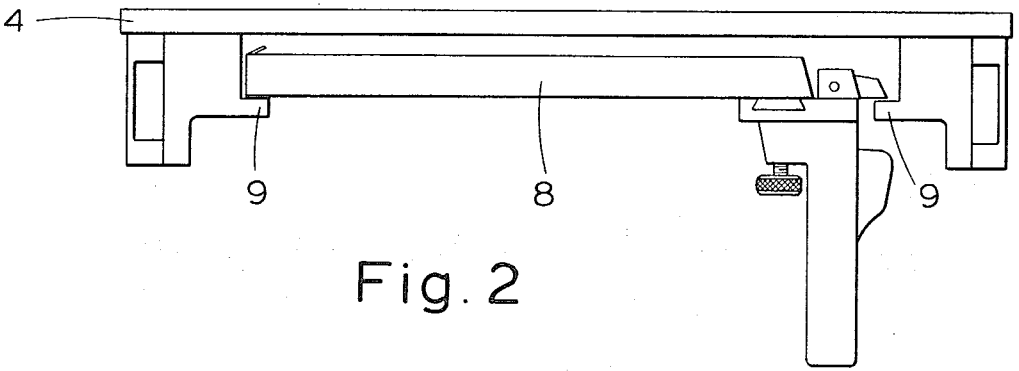
FIG. 2 is a cross-sectional view illustrating an X-ray cassette support.

A support for an X-ray cassette 8 support may be arranged beneath the trunk sections 4, 5. As shown in FIG. 2, this support is in the form of a ledge or rail 9 at each side of the platform on which the cassette 8 can slide.

The support column comprises an outer casing of rectangular cross-section. This outer casing is fixed to the base near one end and is inclined with respect to the vertical. Thus, the outer casing has two opposed surfaces disposed in vertical planes and two opposed surfaces disposed in inclined plates. Movable inside the outer casing is a ram 10, the upper end of which carries the trunk section 5 of the platform. On each of the two inclined walls of the outer casing are internal bearing rollers 11 on which the ram 10 can run. On each of the vertical walls of the outer casing, i.e. the side walls, are internal low friction bearing pads (not visible). The ram 10 is raised or lowered by operation of hydraulic means under the control of either one or two pedals 12 or 13 at opposite ends of the base 3. The pedal 13 is carried by a slide 14 slidable in the base 3 so that its position is adjustable. If desired, the ram can be raised or lowered by electro-mechanical means instead of hydraulic means.

The main trunk section 5 is connected with the top of the ram near one end of the section. The connection is by known means 14 which permit the lateral tilt of the platform or for positioning the trunk sections in the Trendelenburg or reverse Trendelenburg position. Such means can either by mechanical, electro-mechanical or hydraulic. The various movements of the trunk sections are effected under the control of control levers or push buttons mounted on a control arm 15. These levers or buttons act through a mechanical linkage or electrically to engage appropriate gears in a suitable gear box controlling movement of the platform as a whole or of its trunk section. This control arm 15 is mounted on a pivot with a vertical axis below the trunk section. The control arm 15 is movable up or down about a horizontal axis and is also rotatable through about 280° on a vertical axis so that it can be arranged to project from either side of either end of the platform to enable movement of the platform and its section to be controlled from almost any position around the table. If the platform and its trunk sections are moved by a manually operated mechanical drive, such drive may be arranged to provide a high gear setting for moving the platform when it has a low weight load and a low gear setting for use when there is a heavy weight load on the platform.

Figure 3:
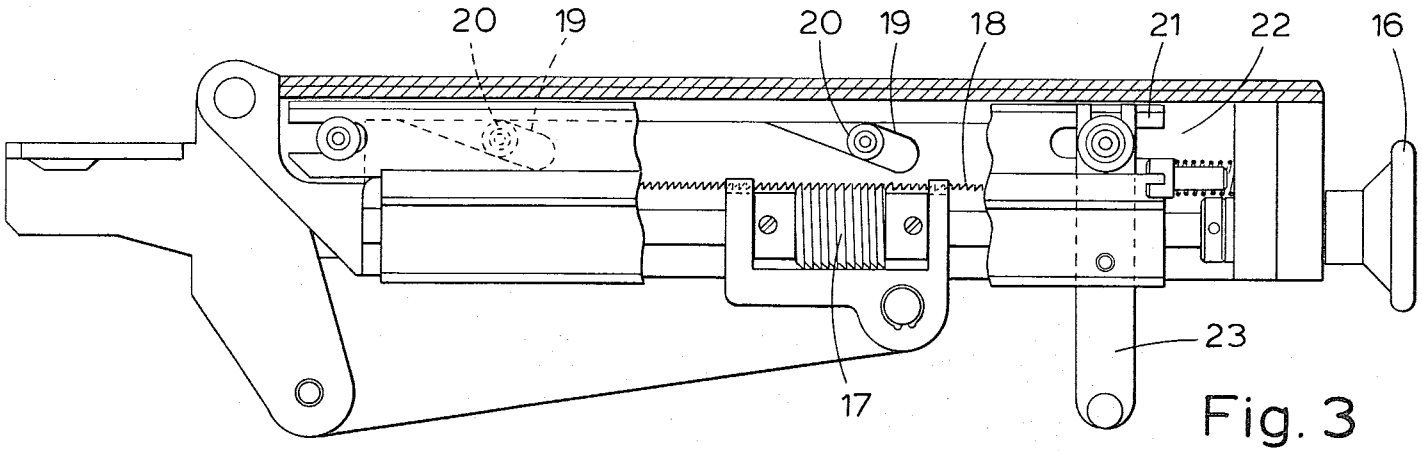
FIG. 3 is a detail view of an extension section assembly.

The angular positions of the end section 6 (which is a head section) with respect to the trunk section 4 can be adjusted independently of movement of the trunk section 4. Such independent movement is effected by means of a drive means including a small hand wheel 16 (FIG. 3) which is mounted on the end section and can be rotated to rotate a worm 17 engaged with a rack 18 in a fixed longitudinal position at one side of the extension. The rack 18 may be disengaged from the worm 17 to permit the section to move up or down as quickly as is desired simply by lifting the rack. In order to enable the rack 18 to be disengaged quickly from the worm 17, the rack 18 has two inclined slots 19 on its inner vertical face, these slots being inclined from the horizontal. A peg 20 fits into each of the two slots 19 and these pegs 20 are attached to a cam plate 21 which is slidable along a metal frame 22 supporting the rack and worm gear. This cam plate 21 can be pulled towards the end of the extension section so that the two pegs then move in the inclined slots to raise the rack out of engagement with the worm. The plate 21 and the pegs 20 may be secured to a cross bar or handle 23 on the section to facilitate lifting movement. The other end or extension section 7 is conveniently a leg-supporting extension section and is adjustable with respect to the trunk section 5 in a similar manner except that it is not provided with a drive wheel 16.

The base 3 is of generally rectangular shape. Friction pads or feet 24 are provided at or near each of the four corners of the base and the table rests in a fixed position on these feet 24 when it is in use for a surgical operation. However, the base is also provided with four castors 25 which can be engaged with the floor, the feet 24 then being lifted from the floor, so that minor adjustment in the position of the base 3 can be made as desired. In order to facilitate larger movements of the base 3, two running wheels 26 are arranged centrally of the base. These running wheels 26 can be engaged with, or disengaged from, the floor as desired. If the table has to be moved any significant distance, these running wheels 26 are engaged with the floor and the table can then easily be pushed over the floor. The diameter of these running wheels 26 should be as large as is convenient because surgical operation tables are inevitably very heavy and the larger the running wheels the greater the ease of movement over the floor. The tread of the running wheels should also be as wide as possible to reduce the danger of damage to the floor.

Figure 4:
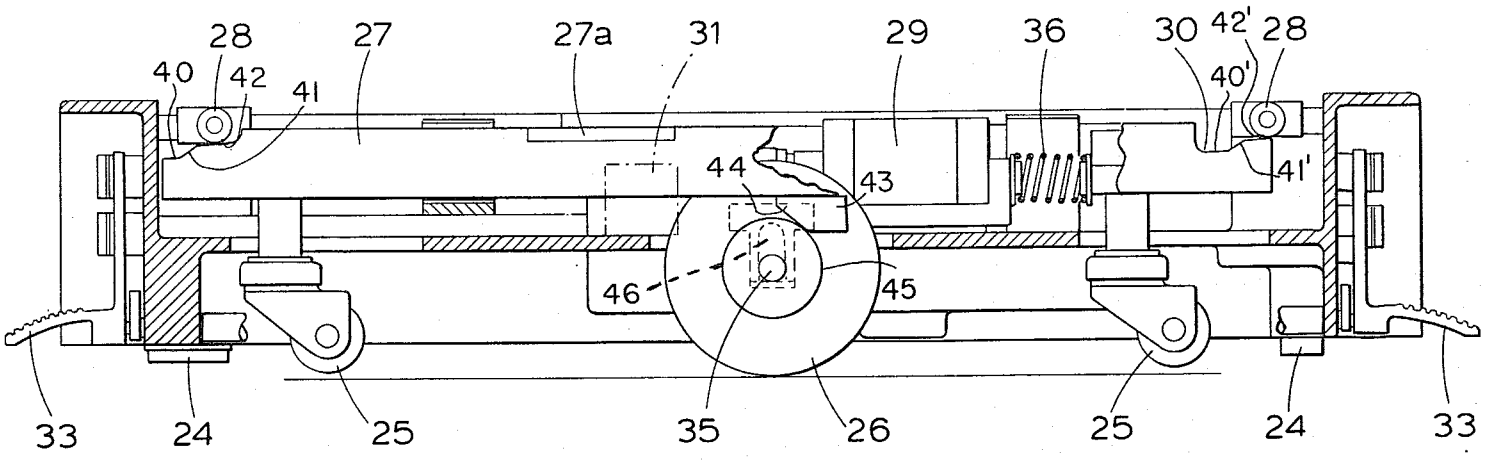
FIG. 4 is a sectional view and FIG. 5 is a plan view of the base of the table.
Figure 5:
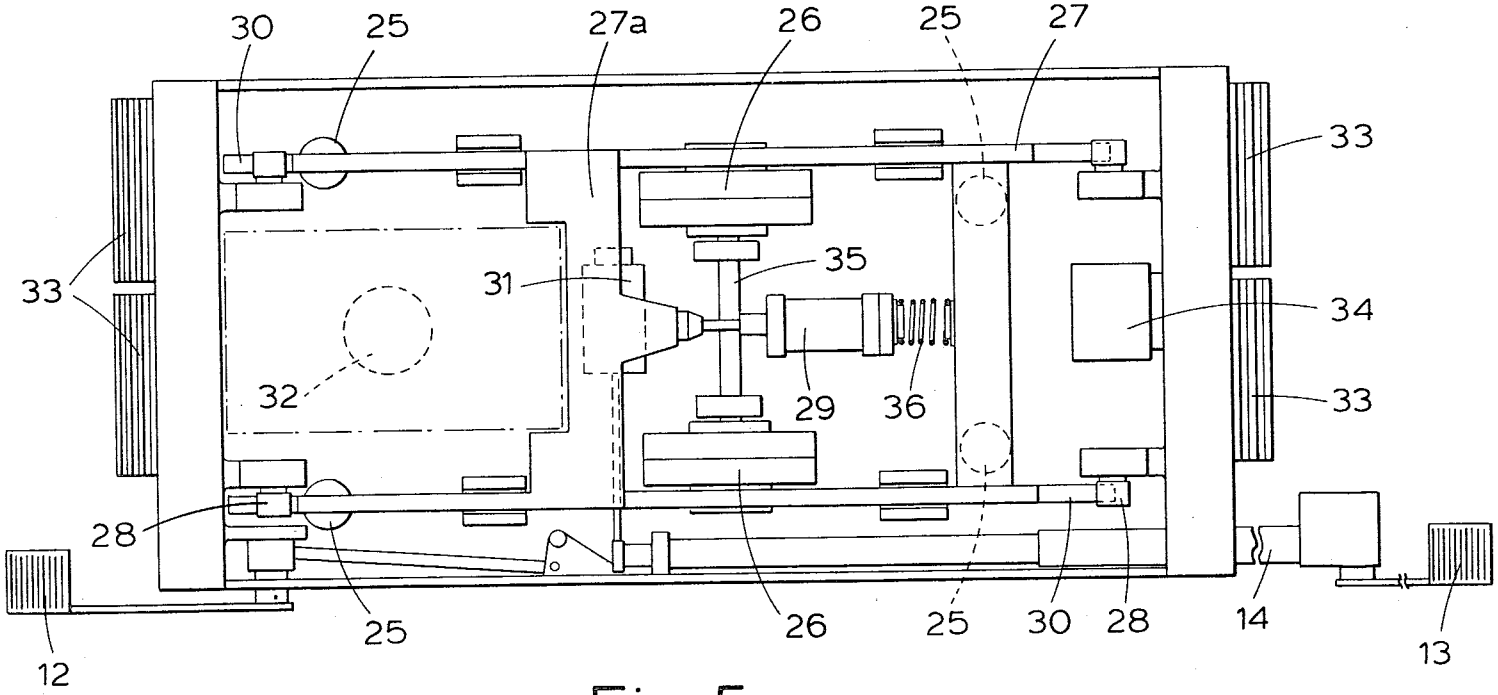

The rectangular base 3 has the outer casing of the support column 2 extending upwards from the top of the base near one end. An H-shaped support frame 27 is arranged within the base, it is not essential that the support frame be H-shaped, but this is the most convenient shape. This H-shaped support frame 27 is slidably mounted in the base on roller bearings 28. The sliding movement of the support frame 27 is in a direction lengthwise of the base and is effected by a hydraulic piston-and-cylinder arrangement 29 working on the cross bar **27*a* of the H-shaped frame. The frame 27 has cam surfaces 30 co-operating with the roller bearings 28 so that when the frame is moved in one direction it is moved downwards towards the floor. The cam surfaces 30 have three specific areas which cooperate with the roller bearings 28. These areas are designated, in FIG. 4, as 40, 41, and 42 for the cam surface and roller bearing illustrated on the left side of the drawing, and as 40', 41', and 42' for the cam surface illustrated on the right side of FIG. 4. With the frame in its upper most position, such that the feet or pads 24 are on the floor, the roller bearings 28 are in contact with area 40 of cam surface 30. When the support frame 27 is slidingly moved to the left, the first position moves roller bearings 28 into contact with area 41 of cam surface 30, causing a first downward movement of H-shaped frame 27. The castors 25 are carried on the underside of the H-shaped frame 27 and such downward movement of the frame will place the castors 25 on the floor and lift the feed or pads 24 from the floor. Such movement is effected by the piston-and-cylinder arrangement 29 as shown or by electrical, mechanical or pneumatic means. The hydraulic pressure for operating the piston-and-cylinder arrangement 29 and also for operating the lift ram 10 is produced by a foot-pump 31. The footpump 31 has its operating pedals 12, 13 at each end of the base and either one of these pedals can be used to obtain the hydraulic pressure necessary to move the support frame or ram. The hydraulic pressure is directed either to a cylinder 32 in which the ram 10 is movable or the arrangement 29 by operation of selector pedals 33 at each end of the base. The selector pedals 33 are arranged in pairs at the two ends of the base. Operation of one pedal of each pair connects the pump 31 with the ram cylinder 32 and operation of the other pedal of each pair connects the pump with the cylinder 29**.

The hydraulic system 29 for moving the H-shaped support frame 27 to engage the feet or castors or wheels with the ground is interconnected with the hydraulic means by a selector valve 34 so that it is impossible to raise or lower the platform 1 except when the base is resting on the four feet.

In an alternative construction, the lift ram can be operated electro-mechanically, mechancially or pneumatically.

The running wheels 26 are supported on a raised axle 35 extending transversely across the base. Further sliding movement of the H-shaped frame 27 causes the running wheels 26 to be engaged on the floor and the castors 25, as well as the feet 24 to be lifted from the floor. This further sliding movement of the H-shaped frame 27 causes roller bearing 28 to be placed in contact with area 41 of cam surface 30. This further movement of the H-shaped frame to the left also causes cam block 43, and particularly its cam face 44, to be placed in contact with portion 45 of running wheel 26. This contact forces axle 35 downwardly in slot 46, so as to place running wheel 26 in contact with the floor, and raise casters 25 from the floor. Although the castors 25 are lifted off the floor, they still act as stabilisers preventing excessive tilting of the table although, of course, some tilting does take place. The base can be returned so as to be supported on the feet by operating the pump pedals 12 or 13, or selecting the ram position with the appropriate selector pedal 33. The weight of the table is sufficient to return the H-shaped supporting frame 27 to its original position thereby to engage the feet or pads 24 with the ground. A coil spring 36 may be provided to assist in returning the frame to its original position. If desired, the frame can be associated with means, such as a bell (not shown) giving an audible indication when the frame 27 arrives at the position to place the castors on the floor. Alternatively, a visual indicator may be provided.

In a modification, the support frame and its associated mechanism is simplified so that the frame is movable to position only the friction pads or feet or the running wheels on the ground.

What we claim is:

1. A surgical operation table or the like comprising a patient supporting surface, a movable base and a column by which the patient supporting surface is mounted on the base, wherein the said base comprises a plurality of feet which can rest on the ground to support the base in a fixed position and running wheels on which the base can be moved, and a support frame displaceable with respect to the base to move the running wheels into the position in which they are engaged with the ground and the feet are clear of the ground, said running wheels being connected to said support frame, a plurality of casters or the like mounted on the support frame, wherein the frame is displaceable with respect to the base from a position in which the running wheels are engaged with the ground and the feet are clear of the ground through a position in which the casters or the like are engaged with the ground and both the feet and the running wheels are clear of the ground to a position in which the feet are engaged with the ground and the casters and running wheels are clear of the ground.

2. A table or the like as claimed in claim 1, wherein the support frame is mounted in the base to reciprocate on bearings and has cam surfaces co-operating with the bearings so that when the frame is displaced in one direction with respect to the base it is guided downwards towards the ground first to an intermediate position in which the castors are placed on the ground and then to a position in which the running wheels are placed on the ground.

3. A table or the like as claimed in claim 2, wherein the support frame is an H-shaped frame and is displaceable by a hydraulic system connected with the cross-bar of the H-shaped frame, hydraulic pressure for displacing the frame in one direction by controlled foot pedals at opposite ends of the base, the frame being returned to its original position on release of hydraulic pressure by the weight of the table or the like assisted by spring means bearing between the frame and the base.

4. A table or the like as claimed in claim 3, wherein the column on which the patient supporting surface is mounted comprises a ram which carries the patient-supporting surface and which can be raised or lowered by another hydraulic pressure system, the two hydraulic systems being interconnected through a valve so that it is impossible to raise or lower the patient supporting surface except when the base is resting on the feet.

5. A table or the like as claimed in claim 4, wherein hydraulic pressure for the hydraulic systems is provided by a foot pump operable by either one of a pair of foot pedals located at opposite ends of the base.

* * * * *